United States Patent [19]

Gencsoy et al.

[11] 4,142,868

[45] Mar. 6, 1979

[54] WEAR COMPENSATING SEAL MEANS FOR ROTARY PISTON COAL FEEDER

[75] Inventors: Hasan T. Gencsoy; John F. Gardner, both of Morgantown, W. Va.

[73] Assignee: The United States of America as represented by the United States Department of Energy, Washington, D.C.

[21] Appl. No.: 902,181

[22] Filed: May 2, 1978

[51] Int. Cl.[2] ..... C10J 3/30; C10J 3/50

[52] U.S. Cl. ..... 48/86 R; 48/77; 277/88; 308/187.1; 414/147

[58] Field of Search ..... 48/86 R, 87, 77; 214/17 A, 17 B, 17 C; 222/194; 202/262; 308/36.1, 187.1; 277/88, 89

[56] References Cited

U.S. PATENT DOCUMENTS

| | | | |
|---|---|---|---|
| 3,127,184 | 3/1964 | Talamonti | 277/88 |
| 3,147,013 | 9/1964 | Tracy | 277/88 |
| 3,194,569 | 7/1965 | Utvitch | 277/88 |
| 3,355,178 | 11/1967 | Hornaday | 277/88 |
| 3,397,894 | 8/1968 | Mastriforte et al. | 277/88 |
| 3,833,273 | 9/1974 | Rickley et al. | 308/36.1 |
| 4,025,317 | 5/1977 | Gencsoy | 48/86 R |

*Primary Examiner*—S. Leon Bashore
*Assistant Examiner*—George C. Yeung
*Attorney, Agent, or Firm*—Dean E. Carlson; Stephen D. Hamel; Earl L. Larcher

[57] ABSTRACT

The present invention is directed to a wear compensating seal arrangement for use in a rotary piston feeder utilized for feeding pulverized coal into a gasifier operating at relatively high pressures and elevated temperatures. The rotary piston feeder has a circular casing with a coal loading opening therein diametrically opposed from a coal discharge and contains a rotatable disoidal rotor having a cylinder in which a reciprocatable piston is disposed. The reciprocation of the piston within the cylinder is provided by a stationary conjugate cam whereby pulverized coal from a coal hopper at atmospheric pressure can be introduced into the cylinder and then discharged therefrom into the high pressure gasifier while maintaining minimal losses of producer gas and the expenditure of minimal energy which would detract from the efficiency of the gasification. The seal arrangement of the present invention is disposed between the rotor and the casing about the coal discharge and prevents the high pressure gases from within the gasifier from escaping between these relatively movable parts during operation of the coal feeder. The seal utilizes a primary seal in contact with the rotor and a secondary seal supporting the primary seal. The primary seal is continuously urged towards the rotor by springs and the high pressure producer gas.

4 Claims, 4 Drawing Figures

1
22

20
32
34
56
12
10
28
50
54
16
43
40
42
52
55
58
67
73
74
76
87
87
25
24
26
1

WEAR COMPENSATING SEAL MEANS FOR ROTARY PISTON COAL FEEDER

This invention was made in the course of, or under, a contract with the United States Department of Energy.

The present invention relates generally to a seal arrangement in a rotary piston coal feeder used for conveying pulverized coal from the coal hopper to a gasifier wherein the conversion of coal to a high or low Btu gas by gasification occurs.

Coal gasification is receiving considerable interest as a method for converting a major energy resource into usable fuels to help satisfy the increasing demand for energy. One of the major problems associated with the operation of coal gasifiers which are operable at pressures up to about 1500 psi and temperatures in the range of about 1700° to 2500° F. has been the transfer of pulverized coal from storage bins at atmospheric pressure into the high pressure gasifiers without suffering extensive system efficiency losses due to the escape of product gas from within the gasifier.

The recently developed coal transfer device which is believed to provide a satisfactory mechanism for efficiently feeding pulverized coal into a gasifier is a rotary piston coal feeder as described in U.S. Pat. No. 4,025,317 which issued May 24, 1977 and is entitled "High Pressure Rotary Piston Coal Feeder for Coal Gasification Applications" by Hasan T. Gencsoy. Inasmuch as the seal arrangement of the present invention is for use with this patented coal feeder, the teachings in this patent are incorporated herein by reference.

Generally, the coal feeder described in the aforementioned patent comprises a casing having diametrically opposed openings, one of which is in open communication with the high pressure gasifier and the other of which communicates with the coal storage. A rotatable disoidal rotor is disposed between the openings within the casing and has a cavity therein defining a cylinder in open registry with the periphery of the rotor. A piston is disposed in the cylinder and has a piston rod attached thereto which projects diametrically through the rotational axis of the rotor. A conjugate stationary cam is carried by the casing and cam following means are affixed to the piston rod for engaging the cam. Drive means are coupled to the rotor for rotating it about its rotational axis while simultaneously driving the cam following means along the contour of the cam for reciprocating the piston within the cylinder. The contour of the cam is such that the piston is displaced towards and maintained at a location contiguous to the outer periphery of the rotor while the piston is in open communication with the discharge opening into the gasifier for inhibiting gas from within the gasifier from entering the cylinder. A cup-shaped rolling diaphragm is affixed to the cylinder walls and overlies the piston for providing a seal capable of preventing the passage of high pressure gases and particulate matter from the gasifier or the coal hopper into the internal parts of the coal feeder via the space between the cylinder and the piston.

While the high pressure gases from the gasifier are effectively stopped from entering the interior of the rotor through the cylinder by the rolling diaphragm, the space between the outer periphery of the rotor and the casing provides a passage which must be effectively sealed from the high pressure gases within the gasifier since the leakage and passage of gases through this space would cause a considerable loss of production gas into the surrounding environment as well as create problems within the coal feeder. Prior art seals have been considered for use in the opening between the gasifier and the rotary piston feeder for sealing the space between the rotor and the casing. However, known seals do not appear to be sufficiently satisfactory since the relative motion between the rotor and the casing together with the presence of the high pressure gases and the abrasive material in the gases render such seals ineffective or subject to excessive wear which would necessitate their replacement at frequent intervals.

Accordingly, it is a primary goal of the present invention to provide a wear compensating seal about the discharge passage between the piston coal feeder and the gasifier which will provide an effective seal between the casing and the relatively movable rotor to effectively inhibit gas losses from the gasifier. This goal is achieved by using an improved seal arrangement comprising primary and secondary seals disposed in the opening leading from the rotary piston coal feeder into the gasifier. The primary seal is provided with a lipped portion disposed in an abutting relationship with the rotor with a further portion of the primary seal extending into and supported by the secondary seal in a relatively movable manner. Bias means bear upon the secondary seal for continually urging the lipped portion of the primary seal into the abutting relationship with the rotor. This seal arrangement of the present invention also includes a chamber between the lipped portion and the secondary seal into which the high pressure gases from the gasifier enter to further urge the lipped portion of the primary seal against the rotor for maintaining the gas tight seal.

Other and further objects of the invention will be obvious from an understanding of the illustrative embodiment about to be described or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated. In the accompanying drawings.

Figure 1:
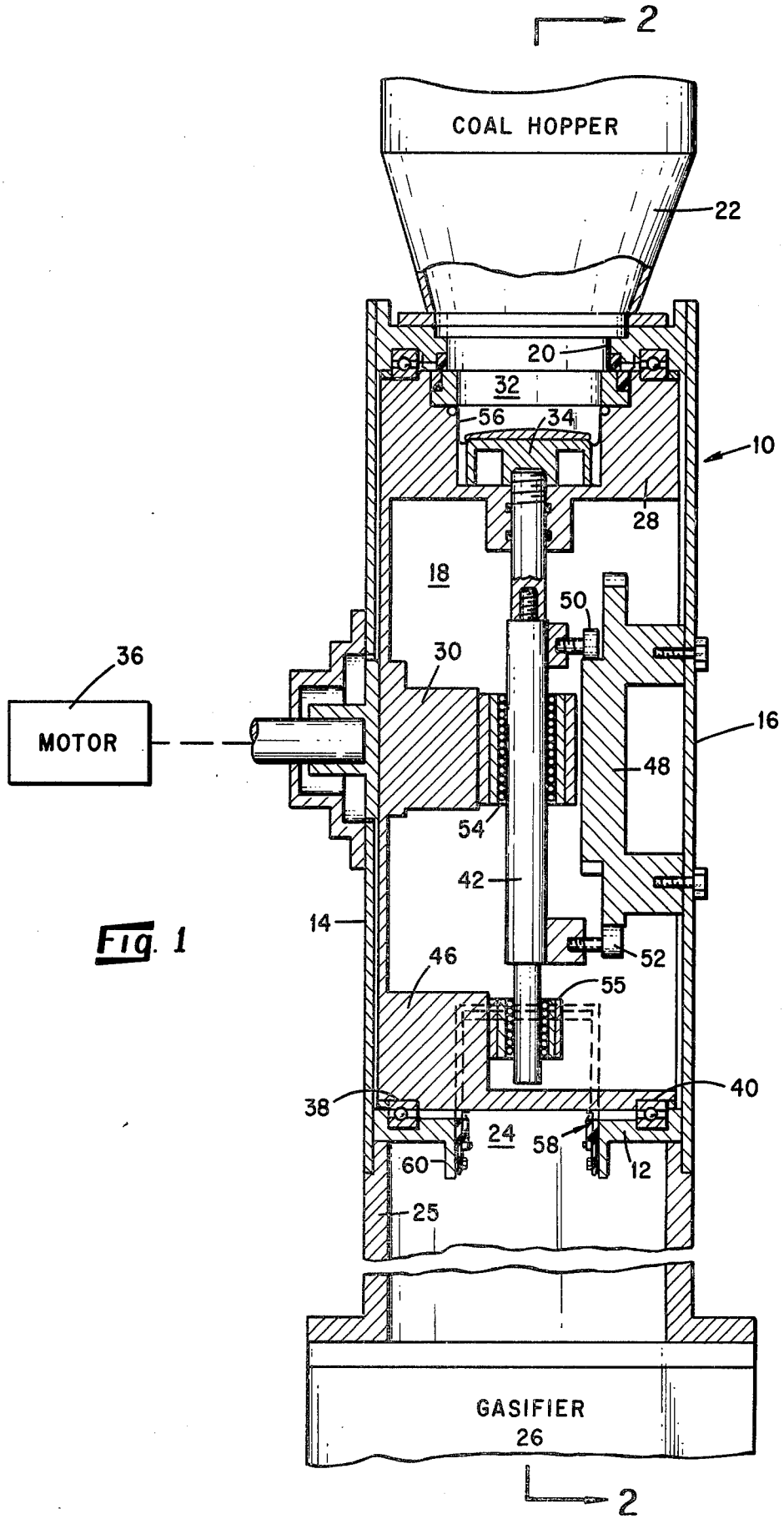
FIG. 1 is an elevated sectional view of the rotary piston coal feeder with the seal arrangement of the present invention.

Generally, the coal transfer device described in the aforementioned patent is used for feeding dry pulverized coal into a coal gasifier operating at a pressure in the range of about 100 to 1500 psig and a temperature in the range of about 1700° to 2500° F. The coal transfer device is located at a distance from the gasifier sufficient to maintain the ambient temperature around the coal discharge chute or opening adjacent to the coal feeder at a temperature in the range of about 250° to 580° F.

This coal feeding device is shown comprising a casing 10 defined by an annulus 12 to which end plates 14 and 16 are attached to define an enclosed circular cavity 18. The annulus has an opening 20 therein which communicates with the coal hopper 22. Annulus 12 also has a second opening therein that is diametrically opposed to the opening 20 with this opening 24 being in registry with a conduit or chute 25 communicating with the interior of a coal gasifier 26. While the opening 24 is described and shown as being of a rectangular configuration, it will appear clear that other opening configurations, such as a planar oblate spheroid, may be used. Accordingly, the seal arrangement of the present invention could be of any desired shape to fit the opening 24.

Within the cavity 18 of the casing 10 there is disposed a disoidal cup-shaped rotor 28 having a central boss 30 disposed on the axis of rotation of the rotor and a circular cavity open at the periphery of the rotor defining a cylinder 32 which houses a displaceable piston 34. The rotor 28 is rotated within the casing cavity by a suitable drive motor and gear reducing arrangement 36. Annular bearings 38 and 40 are disposed in the annular space intermediate the annulus 12 and the rotor 28 near the end walls 14 and 16 to facilitate rotor rotation. The rotor 28 is spaced from the annulus 12 a distance sufficient to assure that the rotor may move freely without contacting the annulus 12.

The reciprocatable piston 34 is coupled to a piston rod 42 which extends through the rotational axis of the rotor and which is coupled to the rotor 28 at the boss 30 at the innermost end thereof and at an inwardly extending shoulder 46 near the periphery of the rotor 28 at a location opposite the cylinder 34 for rotation with the rotor 28 about the axis of the latter. The reciprocation of the piston 34 is provided by a stationary conjugate cam 48 affixed to the end plate 16 and which displaces the piston 34 along a specifically defined contour as the rotor revolves about its axis through the action of a pair of cam followers 50 and 52 coupled to the piston rod 42. Bearings 54 and 55 between the piston rod 42 and the boss 30 and between the piston rod 42 and the shoulder 46, respectively, provide for the relative motion of the piston rod 42 with respect to the rotor 28 for selective displacement of the piston 34 within the cylinder 32 in accordance with the cam configuration during rotor rotation.

A cup-shaped rolling diaphragm 56 of a suitable elastomeric material is placed between the walls of the cylinder and the piston to provide a seal between the piston and the cylinder walls during rotation and displacement of the piston for preventing passage of gases from the gasifier and particulate into the rotor.

Figure 2:
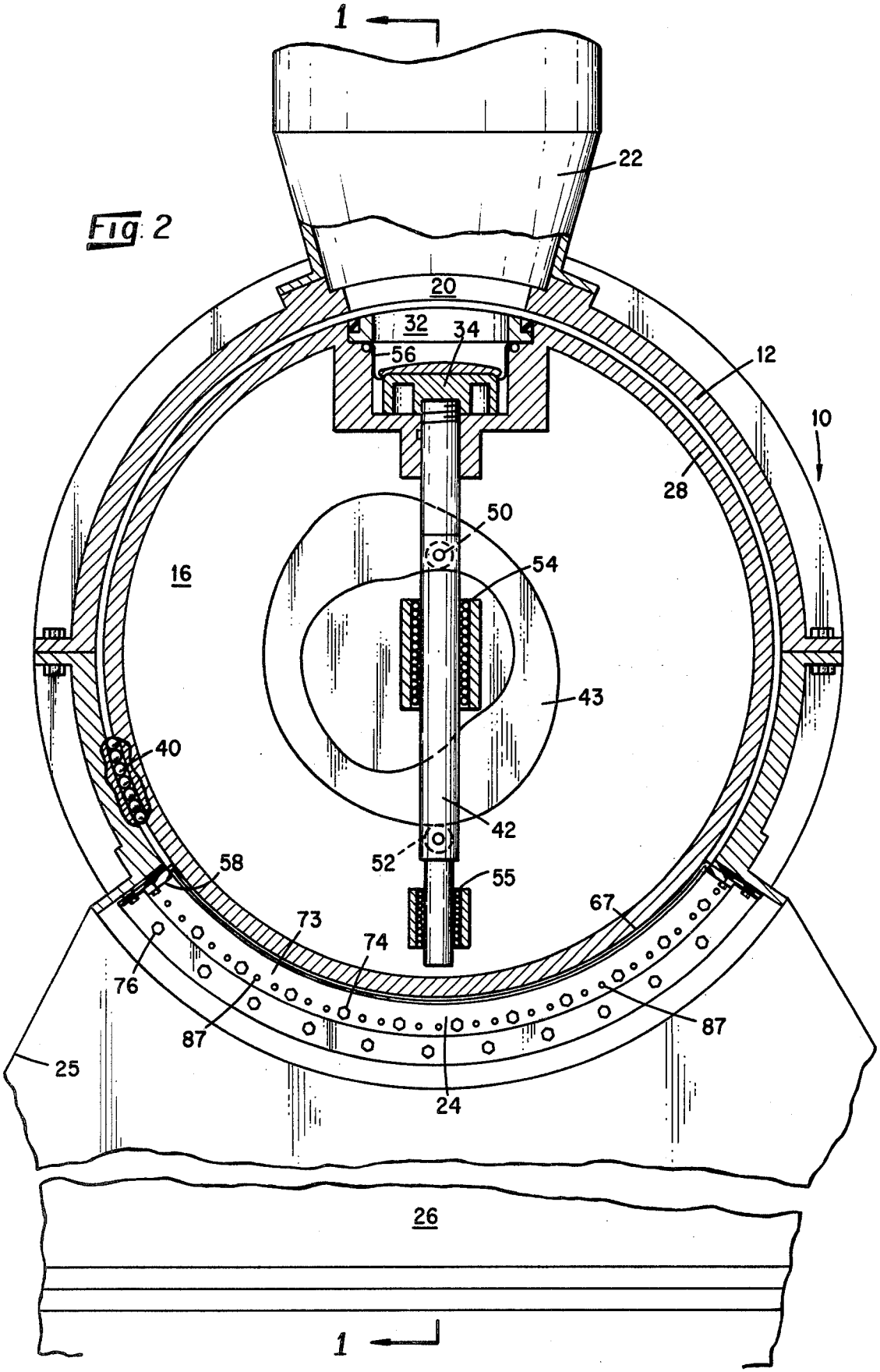
FIG. 2 is a sectional view taken along line 2—2 of FIG. 1 showing further details of the coal feeder and the seal of the present invention.

As shown in the drawings, especially FIG. 2, the openings in the annulus 12 in registry with the coal hopper 22 and the gasifier 26 are of a size suitable for assuring the transfer of coal from the hopper 22 to the cylinder cavity 32 and into the gasifier 26 when the cylinder is rotated within the casing so as to be placed in registry with the gasifier 26. To accomplish this transfer of coal, the opening 20 in the annulus 12 in registry with the hopper 22 may extend over an arc of about 30 degrees so as to permit a full load of coal to be discharged from the hopper 22 into the cylinder 32 by gravity or by a pneumatic or mechanical mechanism when the cylinder is placed in communication therewith. The size of the rectangular opening 24 in the annulus 12 in registry with the gasifier 26 preferably extends over an arc in the annulus of about 90° to 100° to assure that there is sufficient time to allow the piston 34 to be displaced the full length of the cylinder and be positioned in a sealing arrangement with the top of the cylinder for preventing gases from escaping from the gasifier 26 as the cylinder portion of the rotor is past the opening 24.

As the rotor 28 is rotated about the axis defined by the central boss 30 the peripheral surface of the rotor 28 is exposed to high pressure gases and particulate matter from within the gasifier 26. Thus in order to assure that this high pressure gas and particulate matter does not escape from the gasifier 26 via the space between the rotor and the annulus 12 a suitable seal arrangement 58 is placed between the rotor 28 and the annulus 12 adjacent to and surrounding the opening 24 leading into the gasifier.

Figure 3:
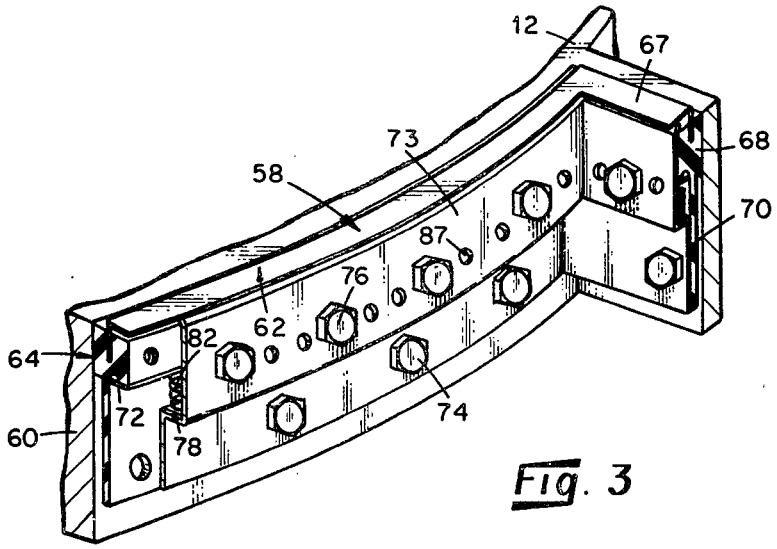
FIG. 3 is a fragmentary sectional perspective view showing details of the improved seal arrangement of the present invention attached to the opening between the gasifier and the rotary coal piston feeder.
Figure 4:
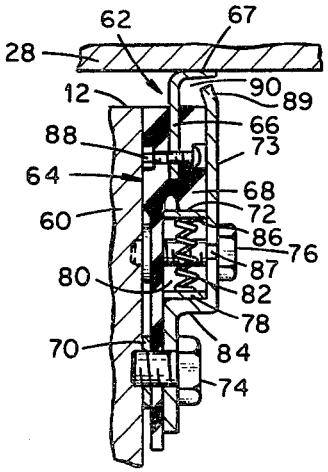
FIG. 4 is an enlarged elevational sectional view showing further details of the seal arrangement of the present invention.

The seal 58 as best shown in FIGS. 3 and 4 is disposed within and around the entire rectangularly shaped opening 24 in the annulus 12 and is fixedly secured to the flanged wall 60 defining the opening 24. The seal comprises a primary seal 62 and a secondary seal 64. The primary seal 62 is formed of a main body portion 66 with an integral lipped or flanged portion 67. The main body portion of the primary seal 62 is oriented in a direction parallel to the wall 60 and perpendicular to the outer surface of the rotor 28 and extends about the entire opening 24. The main body portion 66 of the primary seal is an elongated configuration projecting from within the opening 24 to a location between the annulus 12 and the rotor 28 where it meets with and forms the lipped portion 67. The lipped portion 67 is disposed parallel to and is maintained in an abutting relationship against the peripheral surface of the rotor 28 so as to affect the seal therewith during all phases of rotor rotation. The lipped portion 67 of the primary seal extends from the mean seal portion 66 towards the center of the opening 24.

The primary seal may be formed from an elastomeric material capable of withstanding the temperatures existing at the top of the conduit 25 and possesses a low coefficient of friction. Satisfactory elastomeric materials usable for the primary seal include ethylene propylene diene monomer rubber (EPDM rubber), polyimide-carbon composites and polytetrafluorethylene. Also metals such as phosphor-bronze may be used to form the primary seal.

The secondary seal 64 is carried by the wall 60 contiguous to the opening 24 in the annulus 12 and is utilized to support the primary seal 62 in a manner which will permit vertical displacement of the primary seal for effecting the aformentioned abutting relationship with the rotor 28. Further the secondary seal envelops substantially the entire main body portion 66 of the primary seal 62 so as to prevent the gases from passing around the lower end of the primary seal into the space between the rotor 28 and annulus 12. The secondary seal 64 is formed of a mass of an elastomeric material capable of withstanding the heat and yet of sufficient elasticity so as to provide for the displacement of the primary seal 62 as will be described below. For example, suitable elastomeric materials from which the secondary seal may be formed include EPDM rubber, and high performance elastomers, such as fluoro-elastomers. The secondary seal 64, comprises a relatively massive portion 68 disposed about the opening 24 and contiguous to the uppermost surface of the wall 60 at a location essentially level with the opening 24 in the annulus 12 with this mass being of a sufficient thickness to support the primary seal as well as provide sufficient vertical displacement of the primary seal without employing excessive loadings on the secondary seal. Integral with this relatively massive portion 68 of the secondary seal is a relatively thin portion 70 disposed adjacent to the inner wall of the wall 60 and extending toward the gasifier. The interface between the massive portion 68 and the thin wall portion 70 provides a shoulder 72 which, in turn, provides for a seat for bias means used to displace the primary seal towards the rotor. The secondary seal 64 is fastened to the wall of the conduit 60 by a rectangularly configured metal seal guard 73 which projects about and encloses the secondary seal 64 except for the lowermost and uppermost surfaces of the secondary seal. The seal guard 73 is provided with a plurality of spaced-apart openings in alignment with similar openings through the secondary seal. Bolts, such as generally shown at 74 and 76, are used to attach the seal guard 73 to the wall 60 while simultaneously securing the secondary seal 64 in place against the wall 60. The seal guard 73 is provided with a shoulder 78 of essentially the same dimensions as shoulder 72 on seal 64 with this seal guard shoulder 78 underlying and vertically separated from shoulder 72 for providing a rectangularly configured space or cavity 80 between the guard and the seal. A plurality of vertically oriented springs 82 placed at spaced-apart locations are disposed in this cavity 80 about the entire opening 24. Metal plates 84 and 86 are disposed between the spring ends and the seal shoulder 72 and guard shoulder 78 respectively, to provide a seat for the springs 82 to assure that the spring action will be uniformly applied against the deformable elastic secondary seal portion 68. The springs 82 are under compression in the cavity 80 and act upon the secondary seal to continually urge the secondary seal in a vertical direction towards the surface of rotor 22. This bias on the secondary seal 64 displaces the primary seal 62 to assure that the lipped portion 67 of the latter is maintained in an abutting relationship with the surface of the rotor. The bias provided by the springs 82 is augmented by providing the seal guard 78 with a plurality of passageways 87 in registry with the cavity 80 so as to allow the high pressure gases from the gasifier to enter the cavity 80 and apply a load upon spring plate 86 for displacing the secondary seal portion 68 towards the rotor 28. The primary seal 62 may be secured in position within the secondary seal to assure positive displacement thereof by employing cap screws 88 at uniformly spaced-apart locations. These screws 88 secure the main body portion 66 of the primary seal 62 to the massive portion 68 of the secondary seal 64.

A further sealing function is achieved by extending the uppermost end of the metal guard 73 beyond the plane of the annulus 12 a distance where it will terminate at a location contiguous to, but separate from, the under surface of the lipped portion 67 of the primary seal. This projection 89 of the seal guard, together with the lipped portion 67 of the seal 62, provides a volume 90 between the primary seal, the upper surface of the secondary seal, and the seal guard which enables high pressure gas from the gasifier to enter this volume and urge the lipped portion 67 of the primary seal towards the rotor 28. This guard projection 89 is preferably bent at a slight angle towards the primary seal so as to further define the relatively closed volume 90 and define a narrow passageway between the primary seal and the projection 89 of the seal guard. The relatively larger surface area of the lipped portion 67 of the seal 62 with respect to the upper surface of the secondary seal 64 provides a differential area which allows for the displacement of the lipped portion towards the rotor by the gas entering volume 90.

As will be seen, the improved seal of the present invention provides a wear-compensating seal which will prevent the penetration of the high pressure gases into the interior of the rotary piston coal feeder and enable the coal feeder to operate for a considerably longer duration than achievable by employing previously known seals capable of being employed between relatively movable mechanisms as in the present case.

What is claimed is:

1. A seal arrangement in a coal transfer device used for transferring pulverized coal from a coal hopper to an underlying coal gasifier operable at a substantially higher pressure than that within said hopper, said transfer device comprising a hollow casing having an annulus with diametrically opposed openings therein with the first opening being in communication with said hopper and with the second opening being in registry with the gasifier, a disoidal rotor disposed and rotatable within said casing at a location radially inwardly spaced from said annulus and having a cavity therein defining a cylinder in open registry with the periphery of the rotor, a piston disposed in said cylinder, a piston rod attached to said piston and projecting diametrically through the rotational axis of said rotor, contoured stationary cam means carried by said casing, cam follower means affixed to said piston rod and engaging said cam means, and drive means coupled to said rotor for rotating said rotor about said axis while simultaneously driving said cam follower means along the contour of said cam means for reciprocating said piston within said cylinder, said contour cam means being of a configuration wherein the piston is displaced towards and maintained at a location contiguous to the outermost periphery of said rotor while the cylinder is in open communication with said gasifier for inhibiting gas therefrom from entering said cylinder, said seal arrangement comprising a primary seal and a secondary seal disposed in the second of said openings for inhibiting the passage of gases and particulate matter from said gasifier into the space between the casing annulus and the rotor, said primary seal having a lipped portion thereof disposed in an abutting relationship with the periphery of said rotor, said secondary seal supporting a main body portion of the primary seal in a vertically displaceable manner, bias means bearing against the secondary seal for displacing the primary seal to maintain the lipped portion thereof in said abutting relationship with the periphery of said rotor during rotation of the rotor about said axis, and further means acting upon said lipped portion for augmenting said bias means in urging said lipped portion of the primary seal against said rotor.

2. A seal arrangement in a coal transfer device as claimed in claim 1, wherein the lipped portion of the primary seal disposed in the abutting relationship with the rotor has a lip projecting from the main body portion of the primary seal towards the center of said second opening, said secondary seal is affixed to walls defining said second opening with the uppermost surface of the secondary seal being disposed at a location contiguous with the uppermost part of said walls, said secondary seal comprising a body of elastomeric material of sufficient elasticity to be deformed by said bias means, said main body portion of the primary seal extends from said lip portion across said space to a location within said body of elastomeric material, means for securing said main body portion of the primary seal to said body of elastomeric material for effecting displacement of the primary seal in response to deformation of the elastomeric material by said bias means, wherein seal guard means are disposed against said body of elastomeric material and maintain the latter against said walls.

3. A seal arrangement in a coal transfer device as claimed in claim 2, wherein said bias means comprises a plurality of spaced-apart compressed springs disposed in a cavity between said seal guard means and said body of elastomeric material with said springs being oriented to continually bear against said body of elastomeric material for effecting deformation of the latter and the attendant displacement of the primary seal towards said rotor.

4. A seal arrangement in a coal transfer device as claimed in claim 3, wherein said further means comprises a volume intermediate the primary seal and the secondary seal and defined by the primary seal, the uppermost surface of the secondary seal, and a portion of the seal guard projecting into said space between the rotor and the annulus and terminating at a location underlying and spaced from the lip to define therewith a passageway placing said volume in registry with said opening, and wherein gas from said gasifier communicates with said volume through said passageway to urge said lip towards said rotor.

* * * * *